US008020512B2

(12) United States Patent
Fujimori

(10) Patent No.: US 8,020,512 B2
(45) Date of Patent: Sep. 20, 2011

(54) PATTERN FORMATION DEVICE

(75) Inventor: Eijiro Fujimori, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 500 days.

(21) Appl. No.: 12/197,536

(22) Filed: Aug. 25, 2008

(65) Prior Publication Data

US 2009/0085957 A1 Apr. 2, 2009

(30) Foreign Application Priority Data

Sep. 28, 2007 (JP) ..... 2007-255329

(51) Int. Cl.
*B05C 11/00* (2006.01)

(52) U.S. Cl. ..... 118/708; 347/20; 348/120

(58) Field of Classification Search ..... 118/708; 347/20; 348/125
See application file for complete search history.

(56) References Cited

U.S. PATENT DOCUMENTS

| | | | | |
|---|---|---|---|---|
| 4,493,333 | A * | 1/1985 | Layton | 134/76 |
| 2005/0199410 | A1* | 9/2005 | Voon et al. | 174/65 R |
| 2006/0181567 | A1* | 8/2006 | Tezuka | 347/22 |

FOREIGN PATENT DOCUMENTS

| | | | |
|---|---|---|---|
| JP | 09153530 A | * | 6/1997 |
| JP | H09-153530 A | | 6/1997 |
| JP | 2002-178529 A | | 6/2002 |

OTHER PUBLICATIONS

Translation of JP 09153530 A.*

* cited by examiner

*Primary Examiner* — Dah-Wei Yuan
*Assistant Examiner* — Albert Hilton
(74) *Attorney, Agent, or Firm* — Global IP Counselors, LLP

(57) ABSTRACT

A pattern formation device includes a conveyance table, a pair of guide rails, a carriage, a plurality of droplet discharge heads, an inspection camera, a camera base, a linear motor, a motor housing case, a moving cable, and a cable housing case. The motor housing case is disposed along the guide rails to accommodate the linear motor and has a guide opening configured and arranged to guide the camera base. The cable housing case is disposed along the motor housing case to accommodate the moving cable and has a window section through which a distal end of the moving cable follows a reciprocal operation of the inspection camera. The cable housing case or one of the guide rails has an exhaust vent to discharge air around the carriage by suction through the window section of the cable housing case or the guide opening of the motor housing case.

9 Claims, 7 Drawing Sheets

PATTERN FORMATION DEVICE

CROSS-REFERENCE TO RELATED APPLICATIONS

This application claims priority to Japanese Patent Application No. 2007-255329 filed on Sep. 28, 2007. The entire disclosure of Japanese Patent Application No. 2007-255329 is hereby incorporated herein by reference.

BACKGROUND

1. Technical Field

The present invention relates to a pattern formation device.

2. Related Art

An inkjet device, i.e., a droplet discharge device, for discharging a functional liquid in the form of droplets is commonly known as a pattern formation device for forming a desired pattern on a substrate using a functional liquid. The droplet discharge device forms a pattern by arranging droplets of a functional liquid discharged from a droplet discharge head in arbitrary locations on a substrate while moving the substrate mounted on a stage and the droplet discharge head for discharging droplets of the functional liquid relative to each other in two dimensions.

A droplet discharge device has recently been applied in which a plurality of droplet discharge heads is mounted on a single carriage, and a plurality of carriages is furthermore provided. Such a droplet discharge device is used for large-screen color filter manufacturing and the like, and the drawing speed thereof is enhanced by aligning a plurality of carriages and discharging droplets at the same time.

When the droplet discharge head is discharging, the drive elements and the like provided inside the droplet discharge head give off heat as a result of operation. This heat causes the air around the carriage or the functional liquid inside the droplet discharge head to increase in temperature. It is known that the discharge quantity of droplets from the droplet discharge head also varies according to variation in the viscosity of the functional liquid that accompanies increased temperature of the functional liquid. The droplet discharge device is therefore operated in a clean room in which air-conditioned air (down-flow) is fed from above so that the cleanliness of the area around the substrate is maintained during drawing, and so that the temperature in the room is constant.

The droplet discharge device having a plurality of carriages installed therein as described above is provided with a carriage plate that is positioned across the two guide rails so as to be able to move, and the carriages in which the droplet discharge heads are mounted are provided to the underside of the carriage plate. This structure therefore makes it difficult for a down-flow to be fed to the area around the carriages and droplet discharge heads. In other words, air that is heated by the heat of the droplet discharge heads stagnates in the area around the carriages, which leads to further heating of the droplet discharge heads, and a uniform discharge quantity is impossible to obtain. Japanese Laid-Open Patent Application No. 9-153530 discloses a method for creating a horizontally directed air flow in a clean room in a device having such a structure in which down-flow is blocked.

SUMMARY

However, in the method disclosed in the above mentioned reference, the horizontally directed air flow enters the space between the droplet discharge heads and the substrate and diverts the path of the droplets discharged from the droplet discharge heads, and there is a risk of not being able to land the droplets in the correct positions. An exhaust-dedicated duct may also be placed in the area around the carriages as a method for expelling the air around the carriages, but this method is difficult to implement when the maintenance space of the carriages is considered.

The present invention was developed in order to overcome the above-mentioned problems, and an object of the present invention is to provide a pattern formation device in which the air around the carriage is expelled, and in which the area around the carriage is simplified.

A pattern formation device according to one aspect includes a conveyance table, a pair of guide rails, a carriage, a plurality of droplet discharge heads, an inspection camera, a camera base, a linear motor, a motor housing case, a moving cable, and a cable housing case. The conveyance table is configured and arranged to reciprocally move in a movement path extending in a primary scanning direction to convey a substrate mounted thereon. The guide rails extend in a secondary scanning direction that is orthogonal to the primary scanning direction above the movement path of the conveyance table. The carriage is supported by the guide rails, and configured and arranged to reciprocally move in the secondary scanning direction along the guide rails. The droplet discharge heads are coupled to the carriage, and configured and arranged to discharge droplets of a functional liquid to the substrate to draw a pattern on the substrate while the substrate mounted on the conveyance table moves in the primary scanning direction. The inspection camera is configured and arranged to capture an image of the droplets discharged from the droplet discharge head. The camera base is configured and arranged to couple the inspection camera to one of the guide rails. The linear motor is configured and arranged to reciprocally move the camera base in the secondary scanning direction. The motor housing case is disposed along the guide rails to accommodate the linear motor. The motor housing case has a guide opening configured and arranged to guide the camera base in the secondary scanning direction. The moving cable is electrically connected to the inspection camera. The cable housing case is disposed along the motor housing case to accommodate the moving cable. The cable housing case has a window section through which a distal end of the moving cable follows a reciprocal operation of the inspection camera in the secondary scanning direction. The cable housing case has an exhaust vent at both end parts of the cable housing case to discharge air around the carriage by suction through the window section of the cable housing case.

According to this pattern formation device, the air around the carriage can be expelled by suction through the existing open window of the cable housing case. Consequently, the air around the carriage can be suctioned and expelled without providing an exhaust-dedicated duct to the area around the carriage. As a result, the structure of the carriage area can be simplified, and the number of component parts can be reduced.

By suctioning and expelling the air around the carriage, the carriage area is also placed in a negative pressure state, and air from around the droplet discharge device can be introduced. Temperature increase of the droplet discharge head can therefore be suppressed, and the functional liquid in the droplet discharge head can be maintained at a constant temperature. As a result, the discharge quantity of the droplet discharge head can be made uniform.

Since the air introduced to the area around the carriage from the area around the droplet discharge device does not flow between the droplet discharge head and the substrate, correct landing positioning of the droplets can be ensured.

The pattern formation device may be configured so that the motor housing case has an exhaust vent at both end parts of the motor housing case to discharge the air around the carriage by suction through the guide opening of the motor housing case.

According to this pattern formation device as well, the air around the carriage can be expelled by suction through the existing guide opening of the motor housing case. Consequently, the air around the carriage can be suctioned and expelled without providing an exhaust-dedicated duct to the area around the carriage. As a result, the structure of the carriage area can be simplified, and the number of component parts can be reduced.

By suctioning and expelling the air around the carriage, the carriage area is also placed in a negative pressure state, and air from around the droplet discharge device can be introduced. Temperature increase of the droplet discharge head can therefore be suppressed, and the functional liquid in the droplet discharge head can be maintained at a constant temperature. As a result, the discharge quantity of the droplet discharge head can be made uniform.

Since the air introduced to the area around the carriage from the area around the droplet discharge device does not flow between the droplet discharge head and the substrate, correct landing positioning of the droplets can be ensured.

The pattern formation device may be configured so that the cable housing case includes a partition panel that divides an inside of the cable housing case into a cable housing chamber for accommodating the moving cable with the cable housing chamber having the window section and into a duct passage chamber for transmitting the air suctioned from the window section, and the partition panel has a plurality of uniformly arranged ventilation holes for communicating the cable housing chamber with the duct passage chamber.

According to this pattern formation device, the air around the carriage that is drawn in from the open window is expelled via the cable housing chamber, the ventilation holes, and the duct passage chamber. When exhaust ducts are provided to both end parts of the cable housing case, and the air inside the cable housing case is suctioned, for example, the amount of airflow increases towards the ventilation holes near the exhaust ducts. In other words, the amount of suction is greater at both end parts than near the center of the open window. Therefore, a uniform amount of air suction from the open window can be obtained by appropriately blocking the ventilation holes. As a result, the air around the carriage can be efficiently expelled.

Since the air introduced to the area around the carriage from the area around the droplet discharge device does not flow between the droplet discharge head and the substrate, correct landing positioning of the droplets can be ensured.

The pattern formation device may also be configured so that the window section of the cable housing chamber generally has a diamond-shape in which an open area of the window section is largest in a center part in the secondary scanning direction.

According to this pattern formation device, when exhaust ducts are provided to both end parts of the cable housing case, and the air inside the cable housing is suctioned, for example, the open area is large in the center portion of the open window where the amount of suctioned air is small, and the open area is small at both end portions of the open window where the amount of suctioned air is large. As a result, the amount of air suctioned from the open window can be made uniform.

A pattern formation device according to one aspect includes a conveyance table, a pair of guide rails, a carriage, a plurality of droplet discharge heads, an inspection camera, a camera base, a linear motor, a motor housing case, a moving cable, and a cable housing case. The conveyance table is configured and arranged to reciprocally move in a movement path extending in a primary scanning direction to convey a substrate mounted thereon. The guide rails extend in a secondary scanning direction that is orthogonal to the primary scanning direction above the movement path of the conveyance table. The carriage is supported by the guide rails, and configured and arranged to reciprocally move in the secondary scanning direction along the guide rails. The droplet discharge heads are coupled to the carriage, and configured and arranged to discharge droplets of a functional liquid to the substrate to draw a pattern on the substrate while the substrate mounted on the conveyance table moves in the primary scanning direction. The inspection camera is configured and arranged to capture an image of the droplets discharged from the droplet discharge heads. The camera base is configured and arranged to couple the inspection camera to one of the guide rails. The linear motor is configured and arranged to reciprocally move the camera base in the secondary scanning direction. The motor housing case is disposed along the one of the guide rails to accommodate the linear motor. The motor housing case is communicated with the one of the guide rails. The motor housing case has a guide opening configured and arranged to guide the camera base in the secondary scanning direction. The moving cable is electrically connected to the inspection camera. The cable housing case is disposed along the motor housing case to accommodate the moving cable. The cable housing case is communicated with the one of the guide rails. The cable housing case has a window section through which a distal end of the moving cable follows a reciprocal operation of the inspection camera in the secondary scanning direction. The one of the guide rails has an exhaust vent to discharge air around the carriage by suction through the guide opening of the motor housing case and the window section of the cable housing case.

According to the pattern formation device of the present invention, the air around the carriage can be expelled by suction through the existing open window of the cable housing case, and the existing guide opening of the motor housing case. Consequently, the air around the carriage can be suctioned and expelled without providing an exhaust-dedicated duct to the area around the carriage. As a result, the structure of the carriage area can be simplified, and the number of component parts can be reduced.

By also connecting the exhaust ducts to the guide rails, a high-airflow exhaust path is maintained, and a larger amount of air can be suctioned from the open window of the cable housing case and the guide opening of the motor housing case. Specifically, the carriage area can be placed in a negative pressure state, and more of the air around the droplet discharge device can be introduced to the carriage area. Temperature increase of the droplet discharge head can therefore be suppressed, and the functional liquid in the droplet discharge head can be maintained at a constant temperature. As a result, the discharge quantity of the droplet discharge head can be made uniform.

Since the air introduced to the area around the carriage from the area around the droplet discharge device does not flow between the droplet discharge head and the substrate, correct landing positioning of the droplets can be ensured.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

An embodiment of the pattern formation device in which the present invention is implemented will be described below according to the drawings.

Figure 1:
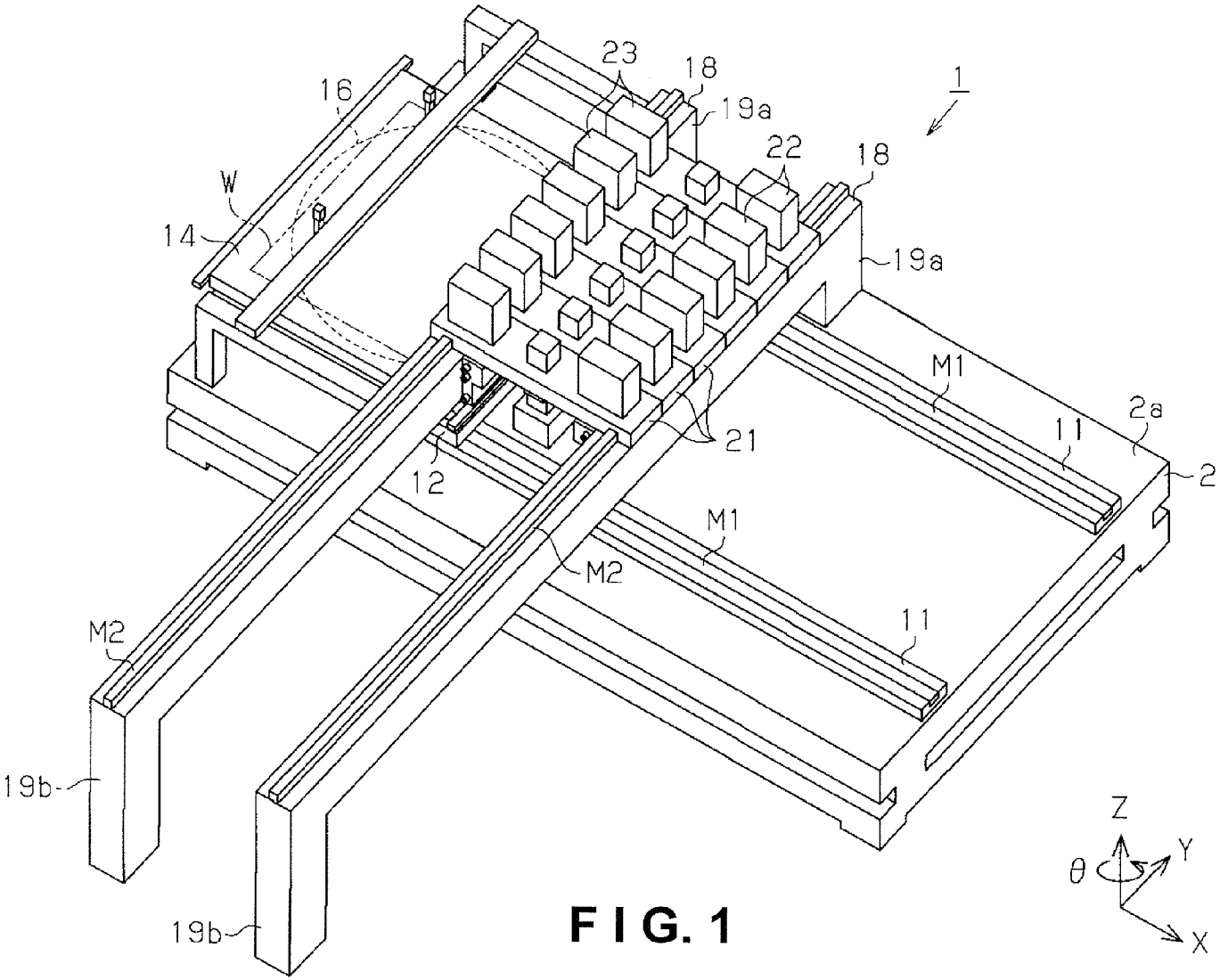
FIG. 1 is a perspective view showing the overall structure of the droplet discharge device.

FIG. 1 shows the overall structure of the droplet discharge device 1 as the pattern formation device for forming red, green, and blue color filters on a glass substrate on which a black matrix is formed. In the droplet discharge device 1 as shown in FIG. 1, a base 2 that extends in the primary scanning direction (X-axis direction) is provided on a floor surface, a pair of X-axis guide rails 11 are laid on the upper surface 2*a* of the base in the primary scanning direction (X-axis direction), and an X-axis movement plate 12 is mounted on the pair of X-axis guide rails 11. The X-axis movement plate 12 is mounted so as to be able to move in the primary scanning direction along the X-axis guide rails 11. X-axis linear motors M1 are provided to the pair of X-axis guide rails 11, and the X-axis linear motors M1 move the X-axis movement plate 12 mounted on the pair of X-axis guide rails 11 back and forth in the X-axis direction via an air slider (not shown).

In FIG. 1, the primary scanning direction is the X-axis direction, the secondary scanning direction orthogonal to the primary scanning direction (X-axis direction) is the Y-axis direction, the direction (vertical direction) orthogonal to the X-axis direction and Y-axis direction is the Z-axis direction, and the direction of rotation about the Z-axis direction is the θ direction.

A substrate stage 14 as a conveyance table is provided on the upper surface of the X-axis movement plate 12. The substrate stage 14 is a vacuum suction table, a color filter substrate (referred to as a CF substrate) W composed of a glass substrate is suction-fixed to the upper surface of the substrate stage, and the CF substrate W is conveyed. The substrate stage 14 is supported and fixed so as to be able to rotate in the θ direction with respect to the X-axis movement plate 12 by a stage rotation mechanism 16 indicated by a dashed line provided between the X-axis movement plate 12 and the substrate stage 14.

Consequently, the substrate stage 14 (CF substrate W) moves together with the X-axis movement plate 12 in the X-axis direction (primary scanning direction). The substrate stage 14 (CF substrate W) also rotates in the θ direction parallel to the plane (XY plane (horizontal plane)) of the X-axis movement plate 12.

A pair of Y-axis guide rails 18 as guide rails are provided so as to straddle over the X-axis guide rails 11 in the Y-axis direction. Support columns 19*a* at one end of the pair of Y-axis guide rails 18 are provided upright on one side of the upper surface 2*a* of the base 2, and support columns 19*b* at the other end are provided upright on the floor at a distance from the base 2. The Y-axis guide rails 18 are arranged parallel to each other across a pre-set interval in the X-axis direction. In the pair of Y-axis guide rails 18 extending parallel to each other in the Y-axis direction in the present embodiment, the position above the base 2 is the work area, and the position at a distance from the base 2 is the standby area.

A plurality (six in the present embodiment) of carriage plates 21 is arranged so as to bridge the space between the pair of Y-axis guide rails 18. The carriage plates 21 are mounted so as to be able to move in the secondary scanning direction (Y-axis direction) along the Y-axis guide rails 18. The Y-axis guide rails 18 are provided with Y-axis linear motors M2, and the Y-axis linear motors M2 move each of the carriage plates 21 mounted on the pair of Y-axis guide rails 18 in the Y-axis direction via an air slider (not shown). In other words, the carriage plates 21 move on the Y-axis guide rails 18 back and forth between the work area and the standby area.

Functional-liquid feeding units 22 and head electrical installation units 23 are mounted on the upper surface of each carriage plate 21. The functional-liquid feeding units 22 are supply circuit devices for storing a prescribed quantity of the functional liquid F (see FIG. 3(*b*)) and feeding the functional liquid F to droplet discharge heads 40 (see FIGS. 3(*a*) and 3(*b*)). The head electrical installation units 23 are electrical circuit devices for feeding electric signals for driving the droplet discharge heads 40.

The functional liquid F referred to herein is red, green, and blue filter ink that is placed in the frames of the black matrix formed on the CF substrate W. The functional liquid F is arranged in the frames of the black matrix formed on the CF substrate W, and is then dried to form red, green, and blue filters.

Figure 2:
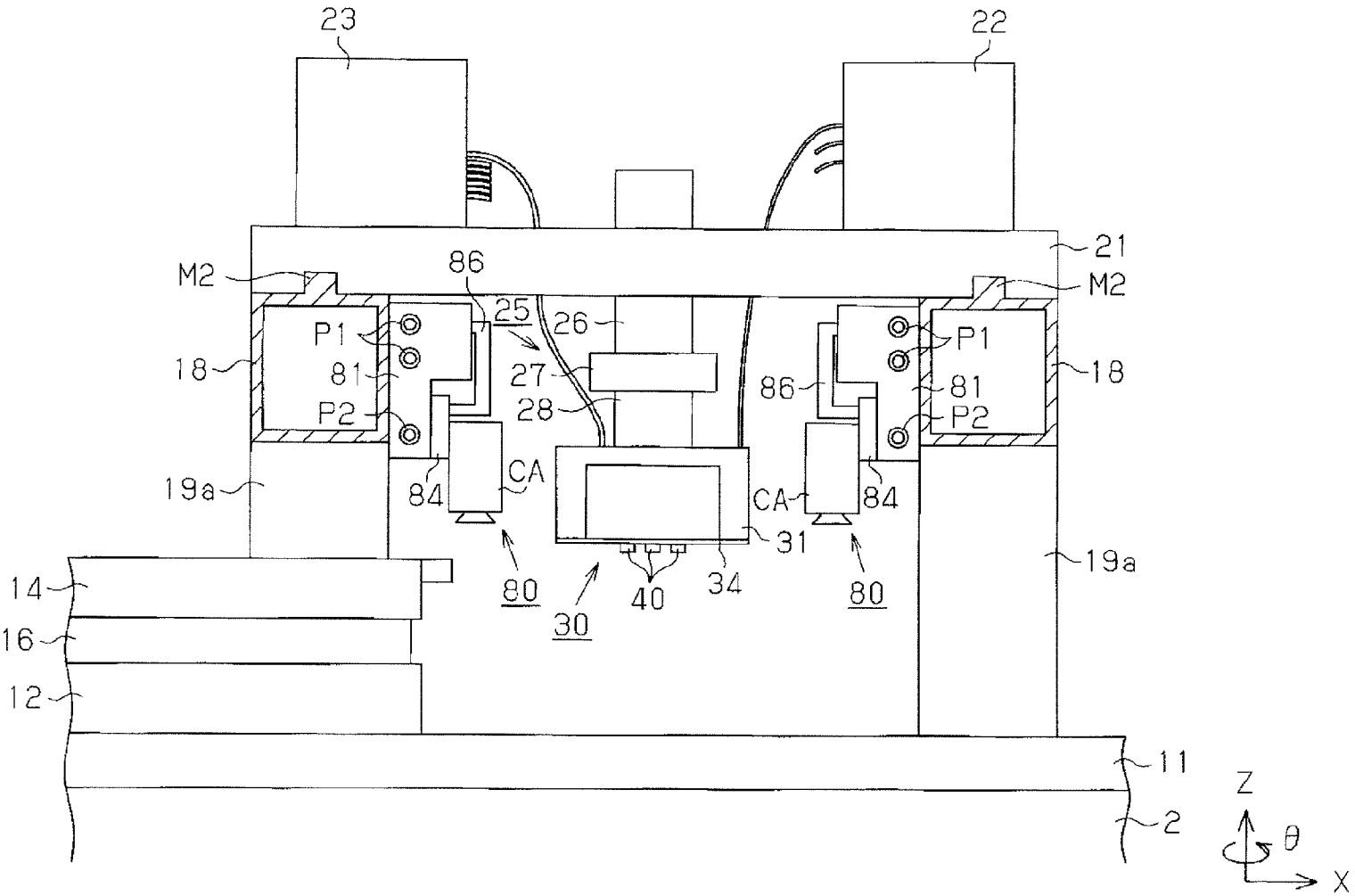
FIG. 2 is a plan view showing the relationship between the carriage plates and the carriage.

As shown in FIG. 2, a suspension mechanism 25 is provided in the center position of the lower surface of each carriage plate 21, and a carriage 30 is attached to the lower end part of the suspension mechanism 25.

The suspension mechanism 25 has a suspension base plate 26, a suspension rotation frame 27, and a suspension support frame 28. The suspension base plate 26 is connected and fixed in position at the center of the lower surface of the carriage plate 21, and the suspension rotation frame 27 is connected to the lower end part thereof. The suspension support frame 28 is connected to and supported by the lower end part of the suspension rotation frame 27 so as to be able to rotate in the θ direction. The suspension rotation frame 27 has a θ-axis rotation motor (not shown), and the θ-axis rotation motor rotates the suspension support frame 28 in the θ direction with respect to the suspension base plate 26 (carriage plate 21). The carriage 30 is supported by and fixed to the suspension support frame 28, and the carriage 30 hung from the suspension mechanism 25 is rotated in the θ direction.

The carriage 30 has a substantially rectangular cuboid carriage frame 31. Open parts are provided on both sides of the carriage frame 31 in the X-axis direction and the Y-axis direction (the open parts in the X-axis direction are not shown), and the surrounding air can flow in and out with respect to the inside of the carriage frame 31. A unit plate 34 is fixed by a screw or the like (not shown) to the lower end part of the carriage frame 31 of the carriage 30. Droplet discharge heads 40 are detachably attached to the unit plate 34 and fixed in precise positions. In the present embodiment, three droplet discharge heads 40 arranged along the X-axis direction are attached in two rows parallel to the Y-axis direction; i.e., a total of six droplet discharge heads 40 are attached. Ducts, wiring, and the like are provided inside the carriage frame 31, but are omitted from the drawings in order to reduce complexity.

Droplet Discharge Heads 40

Figure 3:
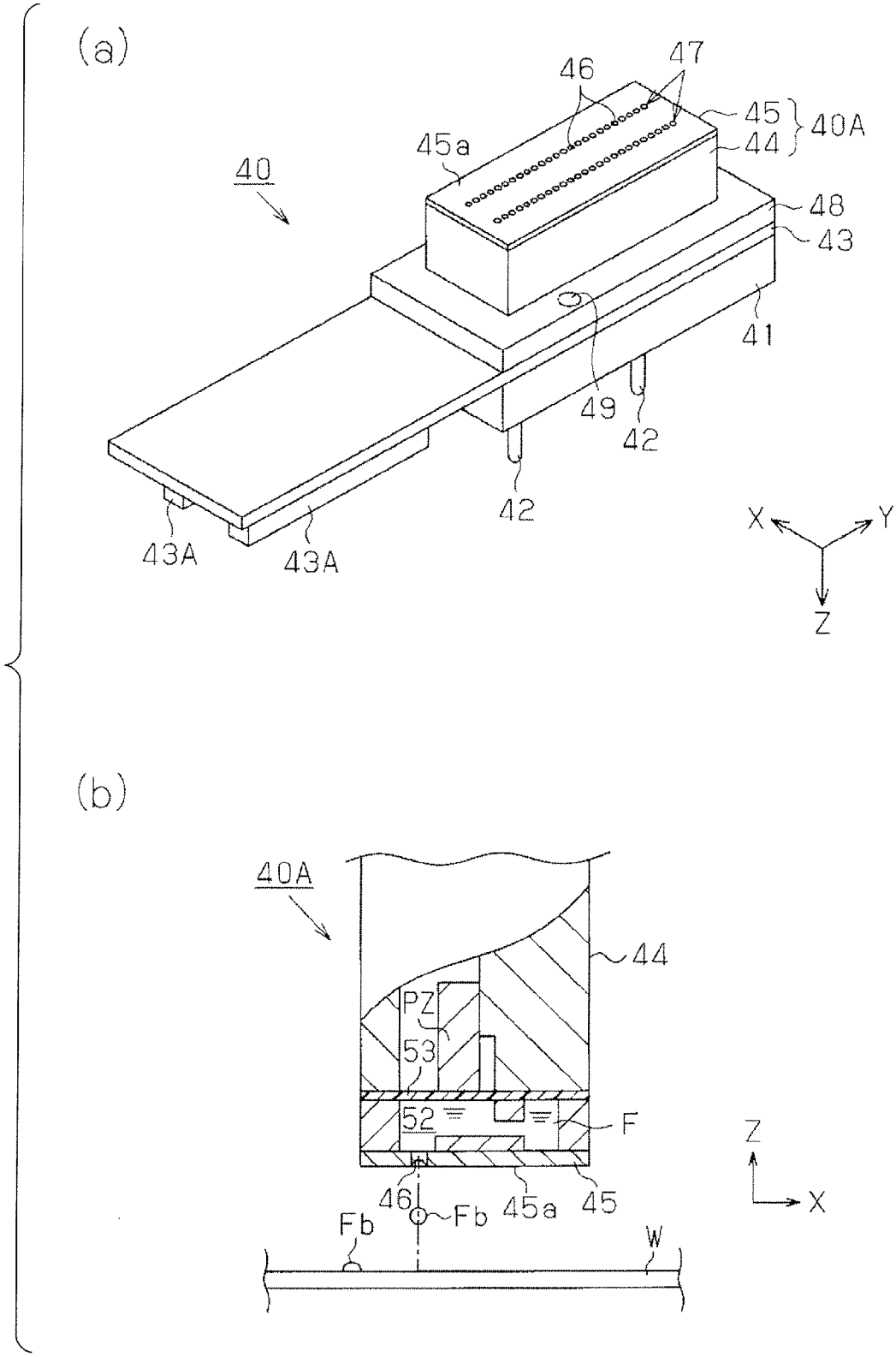
FIG. 3 includes a pair of diagrams (a) and (b) with the diagram (a) being a perspective view showing the droplet discharge head as viewed from the substrate stage; and the diagram (b) being a sectional view showing the pump unit of the droplet discharge head.

The droplet discharge heads 40 attached to the unit plate 34 will next be described with reference to FIG. 3. FIG. 3(*a*) is an external perspective view showing a droplet discharge head as viewed from the substrate stage 14. The droplet discharge head 40 is provided with a liquid body introduction part 41 having two connecting pins 42; a head base plate 43 that continues to the side of the liquid body introduction part 41; a pump unit 44 that continues into the liquid body introduction part 41; and a nozzle plate 45 that continues into the pump unit 44.

A duct connecting member (not shown) that is communicated with the functional-liquid feeding units 22 is connected to the connecting pins 42 of the liquid body introduction part 41. A pair of head connectors 43A are mounted to the head base plate 43, and a flexible flat cable (not shown) connected to the head electrical installation units 23 is connected to the head base plate 43 via the head connectors 43A.

A rectangular head body 40A is formed by the pump unit 44 and the nozzle plate 45.

Two nozzle rows 47 composed of discharge nozzles 46 for discharging droplets are formed in the nozzle formation face 45*a* of the nozzle plate 45. The two nozzle rows 47 are arranged parallel to each other, and each of the nozzle rows 47 is composed of 180 (shown schematically in the drawing) discharge nozzles 46 aligned at an equal pitch. Specifically, the two nozzle rows 47 are arranged symmetrically about the center line of the nozzle formation face 45*a* of the head body 40A.

FIG. 3(*b*) shows the inside of the pump unit 44 of the droplet discharge head 40, and above each of the discharge nozzles 46 is a cavity 52, an oscillation plate 53, and a piezoelectric element PZ. The cavities 52 are connected to a functional-liquid feeding unit 22 via the duct connecting member, and accommodate the functional liquid F (filter ink) from the same functional liquid feeding unit 22 and feed the filter ink to the discharge nozzles 46. The oscillation plates 53 vibrate the regions opposite the cavities 52 in the Z direction, thereby expanding and contracting the volume of the cavities 52, and a meniscus of each discharge nozzle 46 is thereby vibrated. When the piezoelectric elements PZ receive a signal having a prescribed drive waveform, the piezoelectric elements PZ contract and extend in the Z direction, thereby vibrating the regions of the oscillation plates 53 in the Z direction. When the oscillation plates 53 vibrate in the Z direction, a portion of the accommodated functional liquid F (filter ink) in the cavities 52 is discharged as a droplet Fb from a discharge nozzle 46.

A rectangular flange-shaped flange part 48 to receive the liquid body introduction part 41 is formed at the base of the pump unit 44; i.e., the base of the head body 40A. The flange part 48 prevents unseating, and also acts as a connecting part that is connected and fixed to the unit plate 34 by a head fixing screw (not shown). A pair of screw holes (female screws) 49 for small screws that fix the droplet discharge head 40 to the unit plate 34 are formed in the flange part 48. In other words, the head body 40A is inserted through a through-hole (not shown) formed in a prescribed position of the unit plate 34, and the droplet discharge head 40 is fixed to the unit plate 34 by the head fixing screw (not shown) that passes through the unit plate 34 and engages with a screw hole 49.

The X-axis, Y-axis, and Z-axis shown in FIGS. 2 and 3 are the same as the X-axis, Y-axis, and Z-axis shown in FIG. 1. Specifically, in the state in which the unit plate 34 is attached to the droplet discharge device 1, the nozzle rows 47 (see FIG. 3) formed in the droplet discharge head 40 extend in the Y-axis direction.

Drawing Inspection Camera Device 80

Following is a description of the drawing inspection camera device 80 for capturing an image of an alignment mark of the CF substrate W mounted on the substrate stage 14 and measuring the position of the CF substrate W, and capturing an image of an arrangement pattern or the like formed on the CF substrate W to inspect the drawing state.

Figure 4:
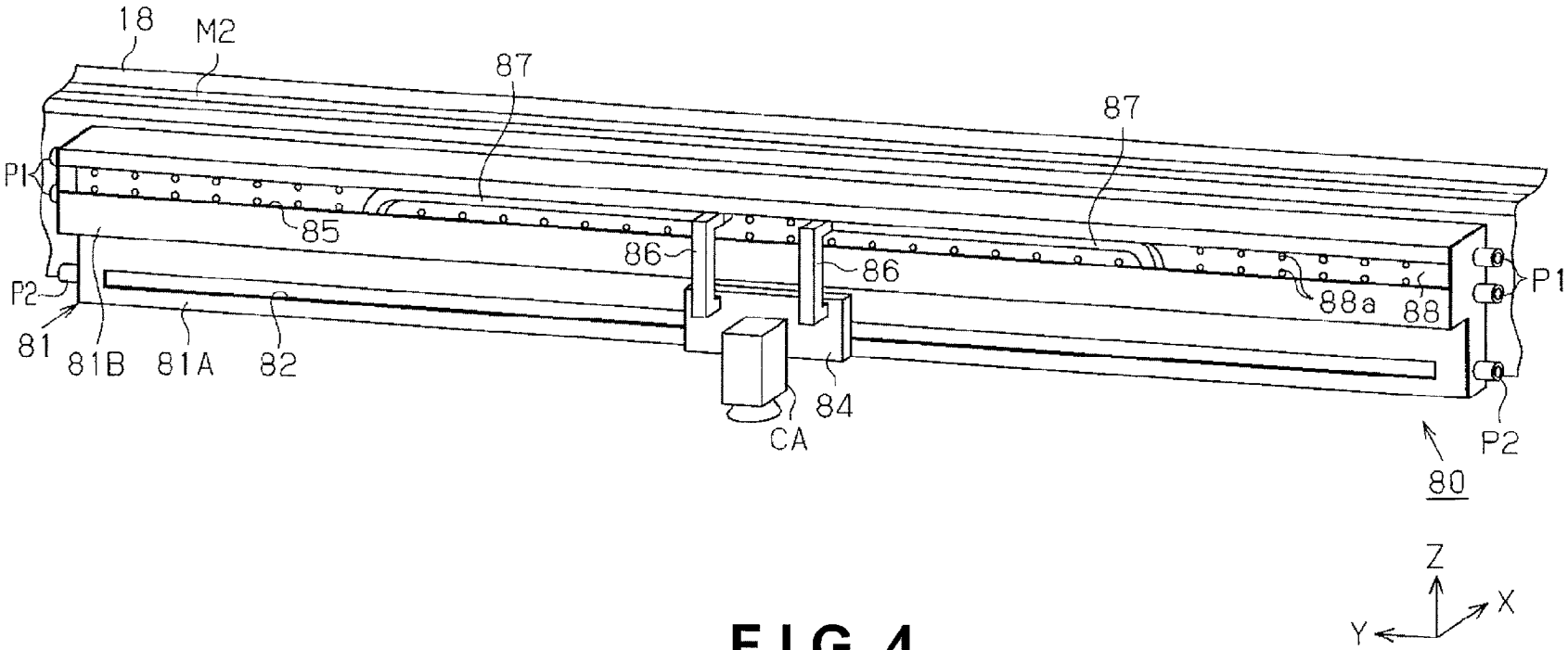
FIG. 4 is a schematic perspective view showing the drawing inspection camera device.

As shown in FIGS. 1 and 2, a drawing inspection camera device 80 is provided on the inside of each of the pair of Y-axis guide rails 18 so as to extend along the Y-axis guide rails 18. FIG. 4 is a perspective view showing the entire drawing inspection camera device 80 provided along the right-side Y-axis guide rail 18 in FIGS. 1 and 2. The drawing inspection camera device 80 provided to the other Y-axis guide rail 18 has the same structure and differs only in positioning, and therefore will not be described.

In FIG. 4, the drawing inspection camera device 80 has a base housing 81. The base housing 81 extends along the Y-axis guide rail 18, the lower half thereof is divided into a camera movement table unit 81A as the motor housing case, and the upper half thereof is divided into a cableveyor duct 81B as the cable housing case.

In the camera movement table unit 81A in the lower half of the base housing 81, a guide opening 82 is formed along the Y-axis direction, and an arm 83 (see FIG. 5) protruding from the guide opening 82 is connected to a base plate 84 as a camera base to which an inspection camera CA is fixed. The arm 83 protruding from the guide opening 82 is able to move in the Y-axis direction along the guide opening 82 with the aid of a linear motor for camera scanning (not shown) that is provided inside the camera movement table unit 81A. Consequently, the inspection camera CA fixed to the base plate 84 can also move in the Y-axis direction along the guide opening 82 with the aid of the linear motor.

As a result, the arrangement pattern drawn on the CF substrate W directly under the path of movement of the inspection camera CA in the Y-axis direction can be imaged by the inspection camera CA moving in the Y-axis direction.

In the cableveyor duct 81B in the upper half of the base housing 81, a drawer hole 85 (window section) is formed in a substantially rectangular shape along the Y-axis direction, and wraparound arms 86 extending from the base plate 84 to which the inspection camera is fixed are inserted into the drawer hole 85, and move along the drawer hole 85 and in the Y-axis direction of the base plate 84 (inspection camera CA).

Inside the cableveyor duct 81B, cables 87 as moving cables for exchanging data signals and exchanging drive power with the inspection camera CA are provided in a flexed state. The distal ends of the cables 87 are connected to connectors provided to the wraparound arms 86, and are electrically connected to the inspection camera CA. The cables 87 are configured so that the curved portions are varied inside the cableveyor duct 81B in conjunction with the movement of the inspection camera CA in the Y-axis direction, and the cables follow the movement of the inspection camera CA.

Figure 5:
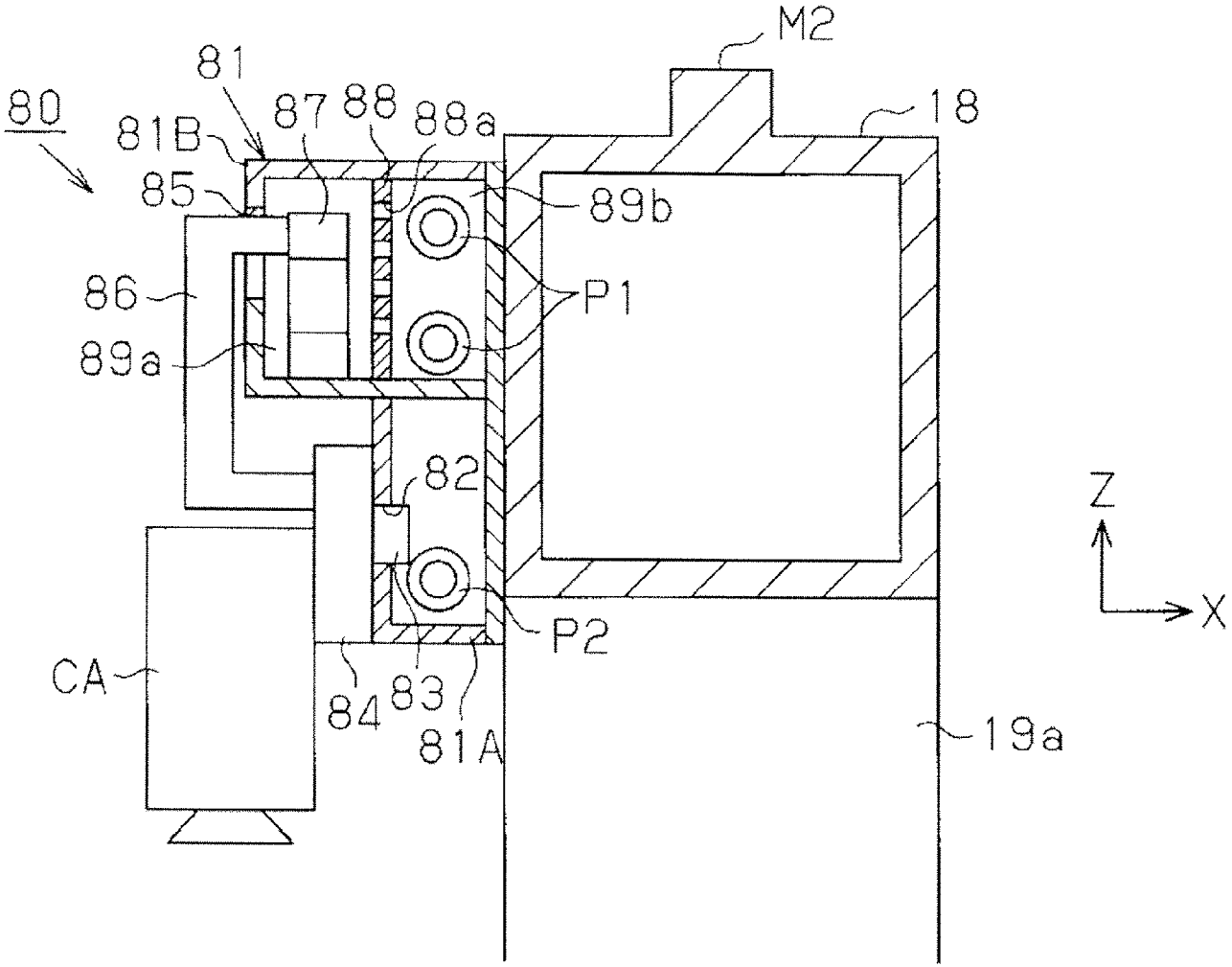
FIG. 5 is a schematic sectional view showing the drawing inspection camera device and the Y-axis guide rail in the first embodiment.

As shown in FIG. 5, the cableveyor duct 81B is partitioned by a partition panel 88, and the side of the drawer hole 85 forms a cable housing chamber 89*a*, and the side of the Y-axis guide rail 18 forms a duct passage chamber 89*b*. Numerous ventilation holes 88*a* having equal open areas are formed in a uniform arrangement in the partition panel 88.

Exhaust ports P1 are also formed in the side wall on the Y-axis side of the duct passage chamber 89*b* (see FIG. 4). The exhaust ports P1 are connected to a suction pump (not shown). Consequently, when the suction pump is driven, and air is suctioned from the exhaust ports P1, outside (near the carriage 30) air is drawn in from the drawer hole 85 of the cableveyor duct 81B, and the indrawn air is expelled or discharged from the exhaust ports P1 via the ventilation holes 88*a* and the duct passage chamber 89*b*.

In the same manner, exhaust ports P2 are provided to both end parts of the camera movement table unit 81A, as shown in FIGS. 4 and 5. The exhaust ports P2 are connected to a suction pump (not shown). Consequently, when the suction pump is driven, and air is suctioned from the exhaust ports P2, outside (near the carriage 30) air is drawn in from the guide opening 82 of the camera movement table unit 81A and expelled from the exhaust ports P2.

Such effects as those described below can be obtained through the embodiment described above.

(1) According to the embodiment described above, the exhaust ports P1 connected to a suction pump (not shown) are provided to the side walls on the Y-axis sides of the duct passage chamber 89*b* of the cableveyor duct 81B that is provided to the base housing 81 of the drawing inspection camera device 80, and the air of the duct passage chamber 89*b* is suctioned. The exhaust ports P2 connected to a suction pump (not shown) are also provided to both end parts of the camera movement table unit 81A, and the air inside the camera movement table unit 81A is suctioned.

Consequently, the air around the carriage 30 can be expelled from the exhaust ports P1 via the duct passage chamber 89*b* and ventilation holes 88*a* from the drawer hole 85 of the cableveyor duct 81B. The air around the carriage 30 can also be expelled from the exhaust ports P2 via the inside of the camera movement table unit 81A.

As a result, since the air around the carriage 30 can be expelled without providing an exhaust-dedicated duct for expelling the air around the carriage 30, the structure of the carriage 30 area can be simplified, and the number of component parts can be reduced.

By suctioning and expelling the air around the carriage 30, the carriage 30 area is also placed in a negative pressure state, and air from around the droplet discharge device 1 can be introduced. Temperature increase of the droplet discharge head 40 can therefore be suppressed, and the functional liquid F in the pump unit 44 can be maintained at a constant temperature. As a result, the discharge quantity of the droplet discharge head 40 can be made uniform.

Since the air introduced to the area around the carriage 30 from the area around the droplet discharge device 1 does not flow between the droplet discharge head 40 and the CF substrate W, correct landing positioning of the droplets can be ensured.

(2) According to the embodiment described above, the inside of the base housing 81 of the drawing inspection camera device 80 is divided into the cable housing chamber 89*a* and the duct passage chamber 89*b*, and the partition panel 88 is provided in which numerous ventilation holes 88*a* having equal open areas are formed in a uniform arrangement.

When air is suctioned from the exhaust ports P1, the amount of airflow through the ventilation holes 88*a* is greater in the ventilation holes 88*a* provided towards the exhaust ports P1 than near the center of the base housing 81 in the Y-axis direction. Therefore, the amount of airflow suctioned from the drawer hole 85 can be made uniform by appropriately blocking the ventilation holes 88*a* positioned towards the exhaust ports P1 using a filmed grommet or the like. As a result, the air around the carriage 30 can be efficiently expelled.

Second Embodiment

A second embodiment of the present invention will be described below according to FIG. 6. For the sake of convenience in the present embodiment, aspects that differ from the first embodiment will be described in detail, and no detailed description will be given of aspects that are basically the same as in the first embodiment.

Figure 6:
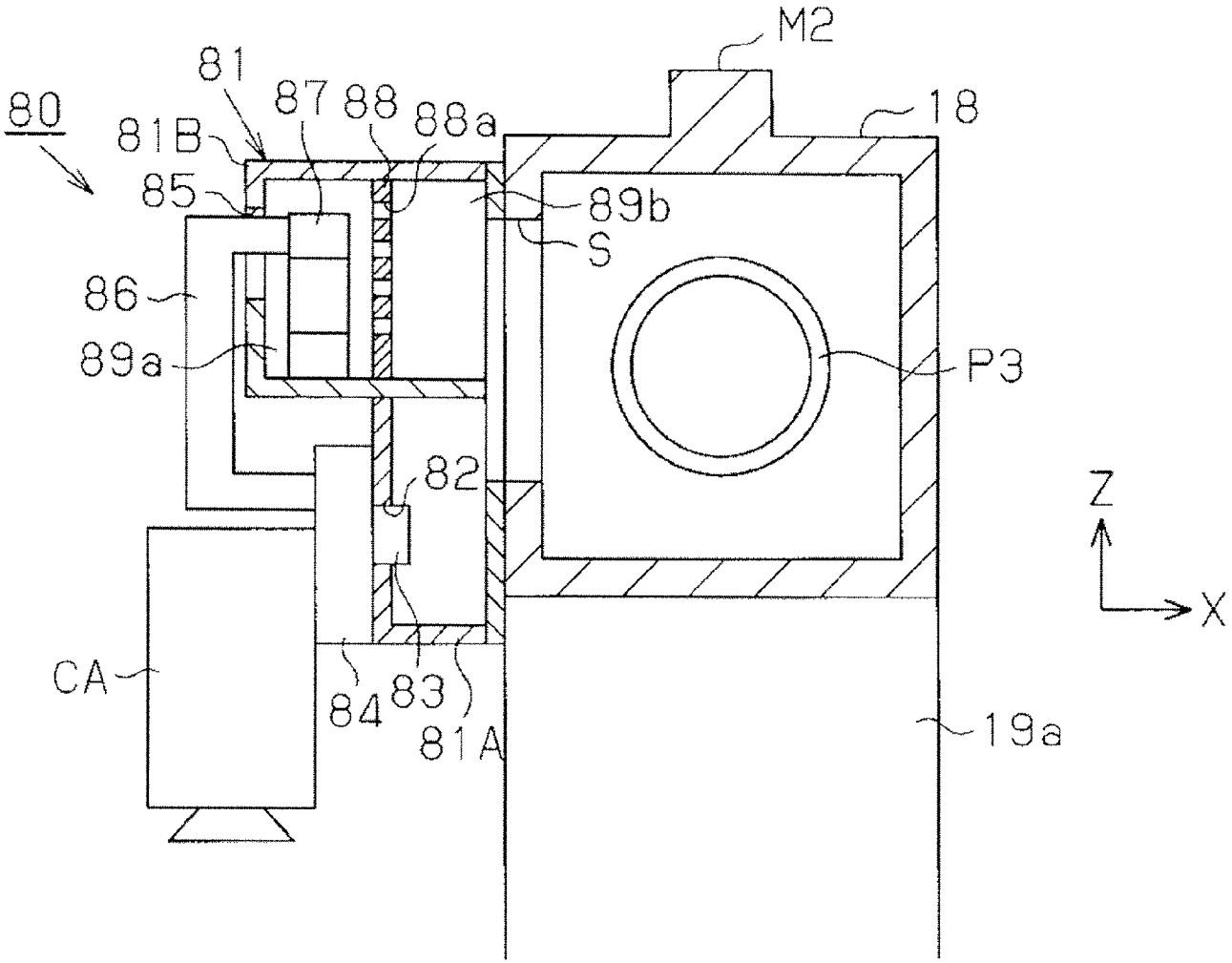
FIG. 6 is a schematic sectional view showing the drawing inspection camera device and the Y-axis guide rail in the second embodiment.

As shown in FIG. 6, through holes are formed in the Y-axis guide rail 18 and the base housing 81 of the drawing inspection camera device 80, and a plurality of communicating channels S for communicating the base housing 81 with the Y-axis guide rail 18 is provided by the through holes. Exhaust ports P3 are formed in the side walls of the Y-axis sides of the Y-axis guide rail 18. The exhaust ports P3 are connected to a suction pump (not shown). The suction pump is driven, and the air inside the Y-axis guide rail 18 is suctioned from the exhaust ports P3, whereby outside (near the carriage 30) air is drawn in from the drawer hole 85 of the cableveyor duct 81B, and the indrawn air is expelled from the exhaust ports P3 via the ventilation holes 88*a*, the duct passage chamber 89*b*, and the communicating channels S.

According to the embodiment described above, such effects as those described below can be obtained in addition to the effects described in (1) and (2) of the first embodiment.

(3) According to the embodiment described above, a plurality of communicating channels S is provided for communicating the Y-axis guide rail 18 and the base housing 81 of the drawing inspection camera device 80. The exhaust ports P3 connected to a suction pump are also provided to the side walls on the Y-axis sides of the Y-axis guide rail 18. The air inside the Y-axis guide rail 18 is suctioned.

Consequently, by utilizing the inside of the Y-axis guide rail 18 as an exhaust duct, a high-airflow exhaust passage can be maintained, and a larger quantity of air can be suctioned. Specifically, the air around the carriage 30 can be efficiently suctioned. As a result, temperature increase of the droplet discharge head 40 can be suppressed, and the functional liquid F in the pump unit 44 can be maintained at a constant temperature.

The embodiment described above may be modified as described below.

Figure 7:
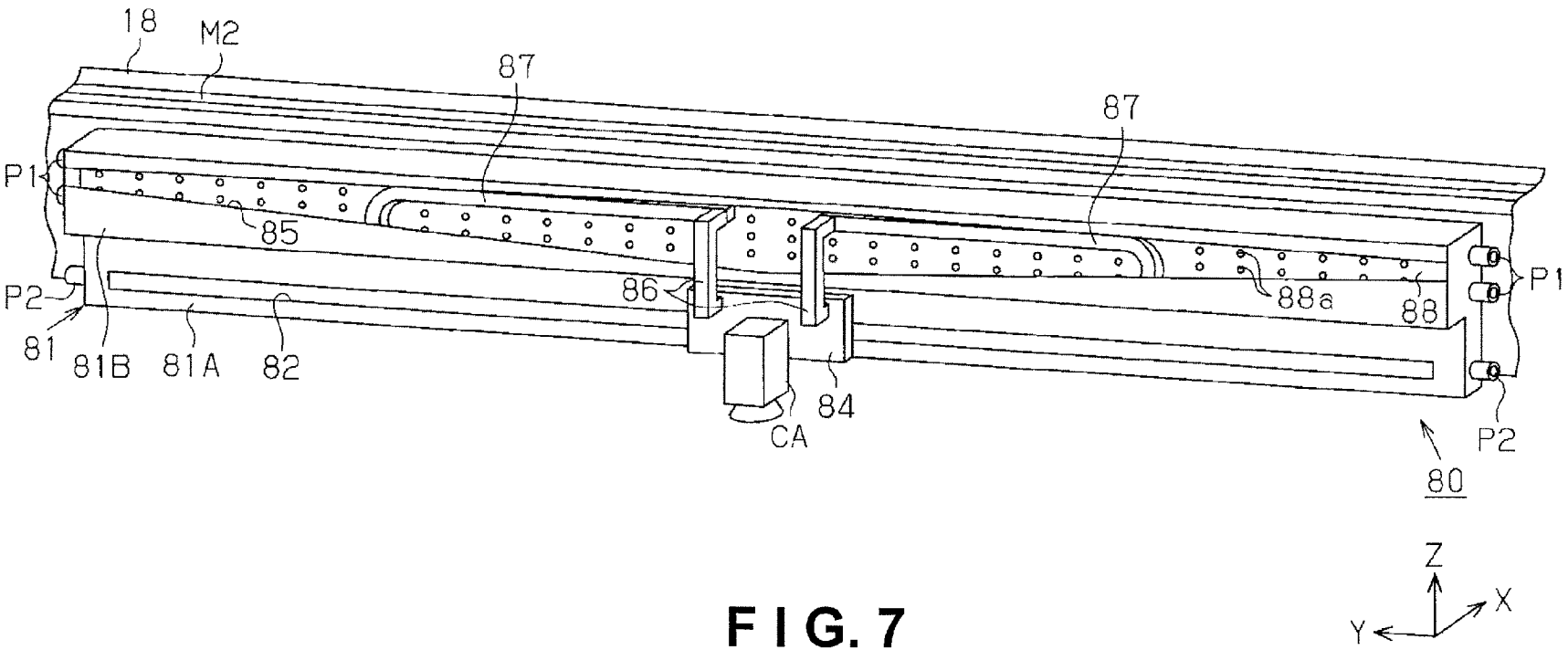
FIG. 7 is a schematic perspective view showing the drawing inspection camera device in another example.

In the first and second embodiments described above, the drawer hole 85 provided to the base housing 81 of the drawing inspection camera device 80 is substantially rectangular. This configuration is not limiting, and the drawer hole may also be substantially diamond-shaped as shown in FIG. 7, wherein the open area is largest in the center part in the Y-axis direction, for example. Through this configuration, since the open area is large in the center part of the base housing 81 in the Y-axis direction, the amount of air suctioned from the drawer hole 85 can be made uniform. As a result, the air around the carriage 30 can be efficiently expelled. Since the partition panel 88 can be omitted, the number of component parts can be reduced.

In the first and second embodiments described above, the amount of air suctioned from the drawer hole 85 is made uniform by appropriately blocking the ventilation holes 88*a* having equal open areas that are provided to the partition panel 88. This configuration is not limiting, and the open area and arrangement of the ventilation holes 88*a* may be appropriately modified; e.g., the size of the open area of the ventilation holes 88*a* may be increased towards the center from both end parts of the base housing 81 in the Y-axis direction, thereby making the amount of suction from the drawer hole 85 uniform.

In the first and second embodiments described above, a droplet discharge device 1 is described in which six carriages are mounted that each have six droplet discharge heads 40 mounted therein. This configuration is not limiting, and the arrangement and number of droplet discharge heads mounted in a carriage, and the number of carriages mounted in the droplet discharge device may be appropriately changed. For example, the droplet discharge device may have a single carriage mounted in which a one droplet discharge head is mounted.

In the first and second embodiments described above, a droplet discharge device 1 is described that discharges filter ink as the functional liquid F. This configuration is not limiting, and the functional liquid F may be an electrode material, a color material, or other functional liquid that is for manufacturing and the like of printing devices including fax machines, copiers, and the like, or liquid crystal displays, EL displays, and surface-emitting displays.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A pattern formation device comprising:

a conveyance table configured and arranged to reciprocally move in a movement path extending in a primary scanning direction to convey a substrate mounted thereon;

a pair of guide rails extending in a secondary scanning direction that is orthogonal to the primary scanning direction above the movement path of the conveyance table;

a carriage supported by the guide rails, and configured and arranged to reciprocally move in the secondary scanning direction along the guide rails;

a plurality of droplet discharge heads coupled to the carriage, and configured and arranged to discharge droplets of a functional liquid to the substrate to draw a pattern on the substrate while the substrate mounted on the conveyance table moves in the primary scanning direction;

an inspection camera configured and arranged to capture an image of the droplets discharged from the droplet discharge heads;

a camera base configured and arranged to couple the inspection camera to one of the guide rails;

a linear motor configured and arranged to reciprocally move the camera base in the secondary scanning direction;

a motor housing case disposed along the guide rails to accommodate the linear motor, the motor housing case having a guide opening configured and arranged to guide the camera base in the secondary scanning direction;

a moving cable electrically connected to the inspection camera; and a cable housing case disposed along the motor housing case to accommodate the moving cable, the cable housing case having a window section through which a distal end of the moving cable follows a reciprocal operation of the inspection camera in the secondary scanning direction, the cable housing case having an exhaust vent at both end parts of the cable housing case to discharge air around the carriage by suction through the window section of the cable housing case.

2. The pattern formation device according to claim 1, wherein the motor housing case has an exhaust vent at both end parts of the motor housing case to discharge the air around the carriage by suction through the guide opening of the motor housing case.

3. The pattern formation device according to claim 1, wherein the cable housing case includes a partition panel that divides an inside of the cable housing case into a cable housing chamber for accommodating the moving cable with the cable housing chamber having the window section and into a duct passage chamber for transmitting the air suctioned from the window section, the partition panel having a plurality of uniformly arranged ventilation holes for communicating the cable housing chamber with the duct passage chamber.

4. The pattern formation device according to claim 1, wherein the window section of the cable housing chamber generally has a diamond-shape in which an open area of the window section is largest in a center part in the secondary scanning direction.

5. The pattern formation device according to claim 2, wherein the cable housing case includes a partition panel that divides an inside of the cable housing case into a cable housing chamber for accommodating the moving cable with the cable housing chamber having the window section and into a duct passage chamber for transmitting the air suctioned from the window section, the partition panel having a plurality of uniformly arranged ventilation holes for communicating the cable housing chamber with the duct passage chamber.

6. The pattern formation device according to claim 2, wherein the window section of the cable housing chamber generally has a diamond-shape in which an open area of the window section is largest in a center part in the secondary scanning direction.

7. The pattern formation device according to claim 3, wherein the window section of the cable housing chamber generally has a diamond-shape in which an open area of the window section is largest in a center part in the secondary scanning direction.

8. A pattern formation device comprising:

a conveyance table configured and arranged to reciprocally move in a movement path extending in a primary scanning direction to convey a substrate mounted thereon;

a pair of guide rails extending in a secondary scanning direction that is orthogonal to the primary scanning direction above the movement path of the conveyance table;

a carriage supported by the guide rails, and configured and arranged to reciprocally move in the secondary scanning direction along the guide rails;

a plurality of droplet discharge heads coupled to the carriage, and configured and arranged to discharge droplets of a functional liquid to the substrate to draw a pattern on the substrate while the substrate mounted on the conveyance table moves in the primary scanning direction;

an inspection camera configured and arranged to capture an image of the droplets discharged from the droplet discharge heads;

a camera base configured and arranged to couple the inspection camera to one of the guide rails;

a linear motor configured and arranged to reciprocally move the camera base in the secondary scanning direction;

a motor housing case disposed along the one of the guide rails to accommodate the linear motor, the motor housing case being communicated with the one of the guide rails, the motor housing case having a guide opening configured and arranged to guide the camera base in the secondary scanning direction;

a moving cable electrically connected to the inspection camera; and a cable housing case disposed along the motor housing case to accommodate the moving cable, the cable housing case being communicated with the one of the guide rails, the cable housing case having a window section through which a distal end of the moving cable follows a reciprocal operation of the inspection camera in the secondary scanning direction, the one of the guide rails having an exhaust vent to discharge air around the carriage by suction through the guide opening of the motor housing case and the window section of the cable housing case.

9. The pattern formation device according to claim 8, wherein the cable housing case includes a partition panel that divides an inside of the cable housing case into a cable housing chamber for accommodating the moving cable with the cable housing chamber having the window section and into a duct passage chamber for transmitting the air suctioned from the window section, the partition panel having a plurality of uniformly arranged ventilation holes for communicating the cable housing chamber with the duct passage chamber.

* * * * *